United States Patent [19]

Ross

[11] Patent Number: 5,068,924

[45] Date of Patent: Dec. 3, 1991

[54] SHOULDER PAD ASSEMBLY

[76] Inventor: Linda Ross, 143 Sullivan St., Apt. C1, New York, N.Y. 10012

[21] Appl. No.: 508,804

[22] Filed: Apr. 12, 1990

[51] Int. Cl.[5] ..... A41B 13/06; A41D 1/20; A41D 11/00

[52] U.S. Cl. ..... 2/268; 450/86

[58] Field of Search ..... 2/2, 44, 268, 267, 92, 2/69, 69.5; 450/86

[56] References Cited

U.S. PATENT DOCUMENTS

| | | | |
|---|---|---|---|
| 640,124 | 12/1899 | Gaddis | 2/268 |
| 689,837 | 12/1901 | Whitney | 2/2 |
| 771,007 | 9/1904 | Glover | 2/2 |
| 890,753 | 6/1908 | Bartran | 2/268 |
| 1,640,042 | 8/1927 | Latina | 2/2 |
| 2,172,807 | 9/1939 | Romane . | |
| 2,402,292 | 6/1946 | Nichols | 2/268 |
| 2,416,415 | 2/1947 | Stehlik | 2/268 |
| 2,467,488 | 4/1949 | Markham | 2/268 |
| 2,665,429 | 1/1954 | Jurich . | |
| 2,676,328 | 4/1954 | Skirow . | |
| 2,763,870 | 9/1956 | Mitchell | 2/268 |
| 2,802,216 | 8/1957 | Vogel | 2/268 |
| 2,986,738 | 6/1961 | Zubiate | 2/268 |
| 3,421,514 | 1/1969 | Friedlander | 450/86 X |
| 3,422,818 | 1/1969 | Erteszek | 450/86 X |
| 4,135,252 | 1/1979 | Latina . | |
| 4,554,681 | 11/1985 | Kirkland . | |
| 4,675,912 | 6/1987 | Kirkland . | |
| 4,675,917 | 6/1987 | Valli | 2/268 |
| 4,679,253 | 7/1987 | Mitchell . | |
| 4,680,814 | 7/1987 | Mitchell . | |
| 4,715,066 | 12/1987 | Mitchell . | |
| 4,795,400 | 1/1989 | Greenberg | 450/86 X |
| 4,872,216 | 10/1989 | Wingo . | |
| 4,894,868 | 1/1990 | Christopher | 450/86 X |

FOREIGN PATENT DOCUMENTS

| | | | |
|---|---|---|---|
| 213443 | 2/1957 | Australia | 2/2 |
| 354738 | 1/1958 | Switzerland | 2/2 |

*Primary Examiner*—Werner H. Schroeder
*Assistant Examiner*—Jeanette E. Chapman
*Attorney, Agent, or Firm*—Nolte, Nolte and Hunter

[57] ABSTRACT

A shoulder pad assembly for fashionably shaping the shoulders beneath a wearer's clothing. A shoulder pad assembly is worn independently of the wearer's clothing beneath a blouse, shirt, dress or sweater. The invention includes a pair of fashionably shaped shoulder pads, completely enclosed in fabric pockets. The pockets are connected by a panel across the wearer's back behind the wearer's neck. Under-arm straps hold the assembly in place upon the wearer's shoulders independently of other garments.

1 Claim, 8 Drawing Sheets

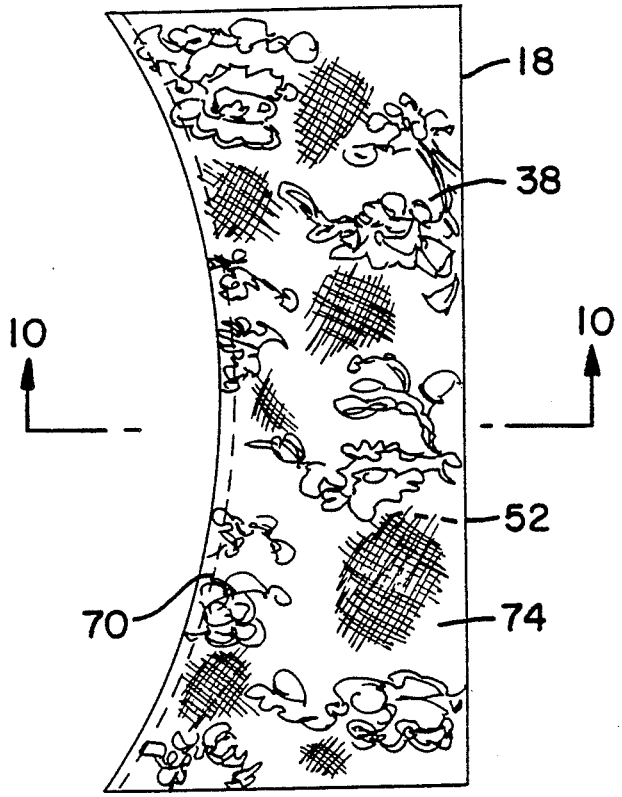
FIG. 9
FIG.10
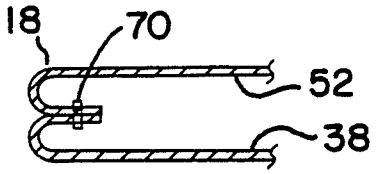
FIG.10A
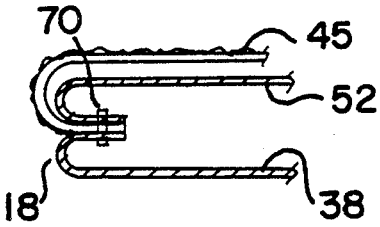

SHOULDER PAD ASSEMBLY

The present invention relates to a shoulder pad assembly. In particular, it relates to an assembly designed to be worn independently of any particular garment, to pad a wearer's shoulders for fashion purposes beneath a blouse, shirt, dress, or sweater.

BACKGROUND

The fashion world has long been desirous of achieving a broad shouldered look. Toward this end, various forms of shoulder pads have been designed to be sewn into garments such as jackets or dresses. Shoulder pads have also been designed to attach to underwear.

OBJECTS

It is the object of the present invention to provide a self-contained assembly which allows shoulder pads to be worn beneath clothing, independently of attachment to any other garment. It is an object of the present invention to provide a pair of shoulder pads which may be worn with the wearer's entire wardrobe, and need not be transferred from one garment to another. It is another object of the present invention to provide shoulder pads which remain securely and positively in their intended location atop the wearer's shoulders, but yet which are comfortable to wear and easy to don and remove.

BRIEF DESCRIPTION

The present invention comprises a pair of shoulder pads. The shoulder pads are completely enclosed in a pair of fabric pockets which are connected to each other by a back piece which lies atop the shoulders behind the wearer's neck.

Adjustable arm straps depend from either side of the back piece, in order to hold the assembly upon the wearer's shoulders.

In use, the wearer dons the shoulder pad assembly either before or after putting the wearer's underwear on. A shirt, blouse, dress, or sweater is then worn over the shoulder pads.

BRIEF DESCRIPTION OF THE DRAWINGS

FIG. 9 is a plan view of the back panel, turned inside out showing the fabric panels which comprise it and the seam which joins those panels together.

FIG. 10 is a section taken through the plane indicated by number 10 in FIG. 9 but taken after the back panel has been turned outside-out.

FIG. 10A is a similar view of an embodiment with a layer of lace sewn atop.

DETAILED DESCRIPTION OF THE DRAWINGS

Figure 1:
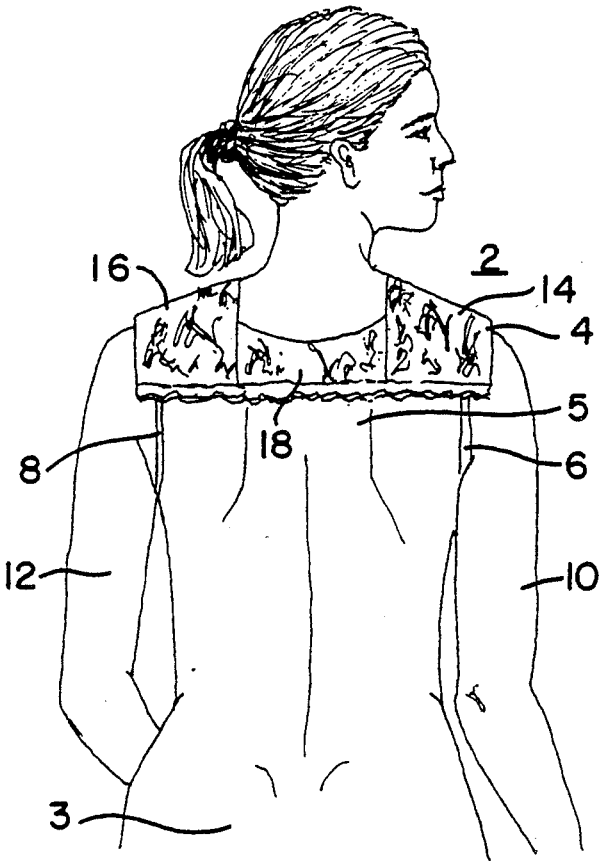
FIG. 1 is a rear elevation of the present invention upon a wearer.

FIG. 1 shows the shoulder pad assembly, generally designated 2, of the present invention resting on the shoulders of a wearer 3. The assembly 2 comprises a pad-panel assembly 4 from which straps 6, 8 depend. Straps 6, 8 loop under the wearer's arms 10, 12 around the armpits and secure the pad-panel assembly 4 to the wearer's back 5 and shoulders. Pad-panel assembly 4 comprises a pair of shaped foam shoulder pads which are sewn in to a pair of pockets 14, 16. Pad pockets 14, 16 are connected by back panel 18.

Figure 2:
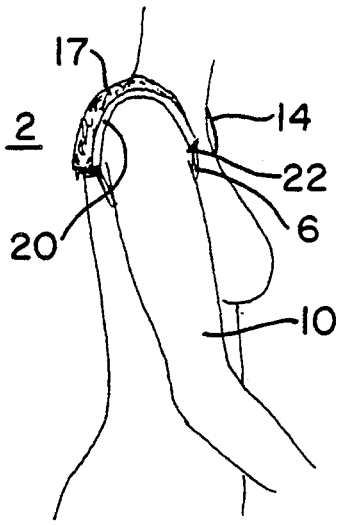
FIG. 2 is a side elevation thereof.

Turning now to FIG. 2, assembly 2 is viewed from the right side. Pad pocket 14 is shown comprising upper pocket panel 17, which is extended to form a right side panel 20, which holds the shoulder pad within. Side panel 20 is assembled to the lower panel by seam 22. Strap 6 is shown holding the assembly on to the wearer's shoulder by looping beneath the wearer's arm 10.

Figure 3:
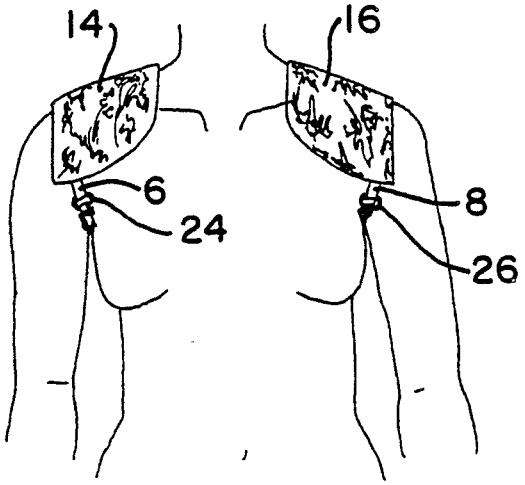
FIG. 3 is a front elevation thereof.

Turning now to FIG. 3, pad pockets 14, 16, are shown held by straps 6 and 8 as viewed from the front of the wearer. O-rings 24 and 26 are also shown.

Figure 4:
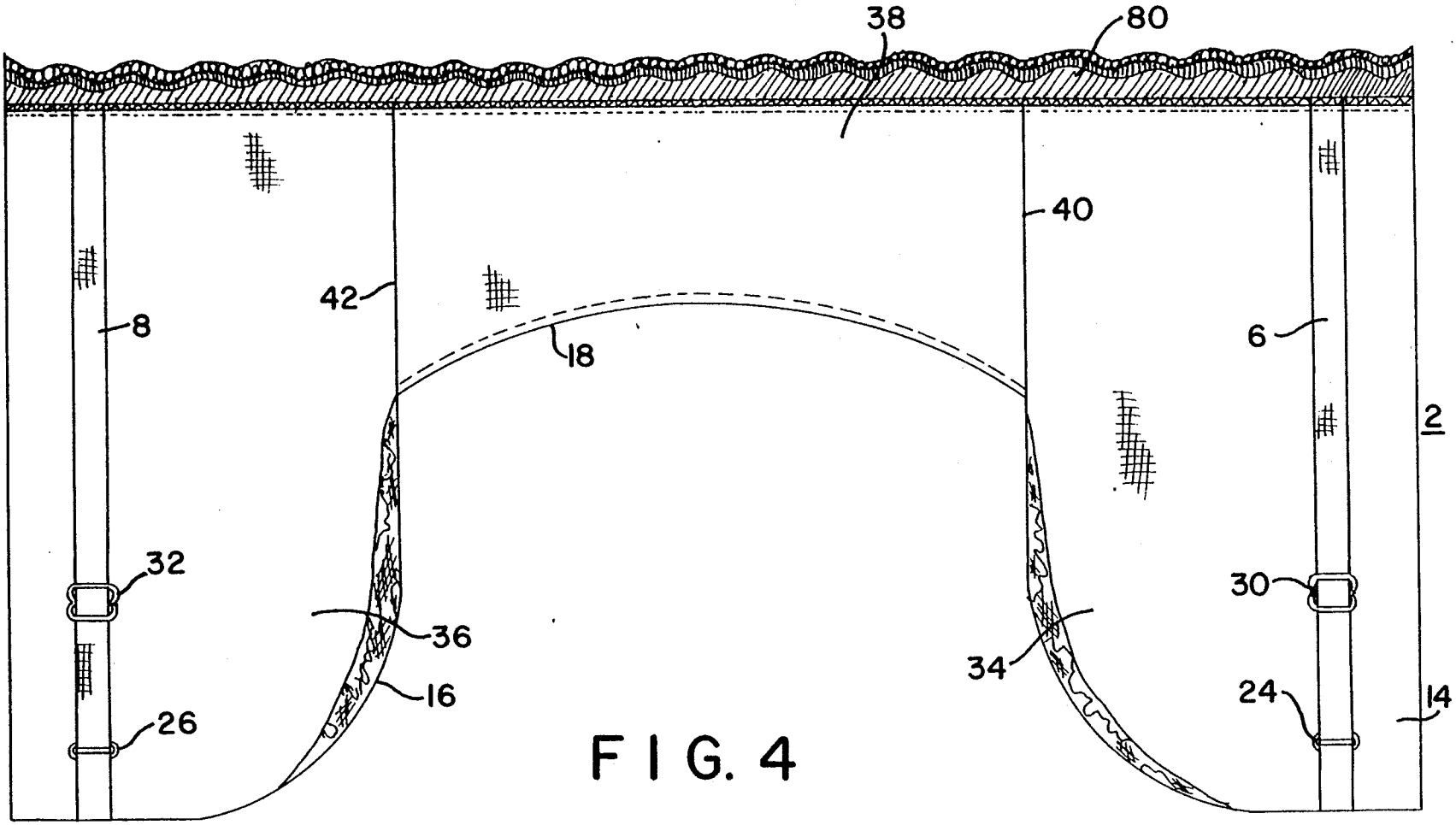
FIG. 4 is a plan view, from beneath, of the present invention.

Turning to FIG. 4, a plan view from below of the assembly is shown, slightly wrinkled so that the assembly could fit upon the photocopy machine from which the original informal drawing was made as a photo reduction of the actual garment. Adjustment means for straps 6 and 8 comprise O-rings 24 and 26 and buckles 30, 32. Lower pocket panels 34, 36 are secured to the lower back panel 38 at seams 40, 42.

Figure 5:
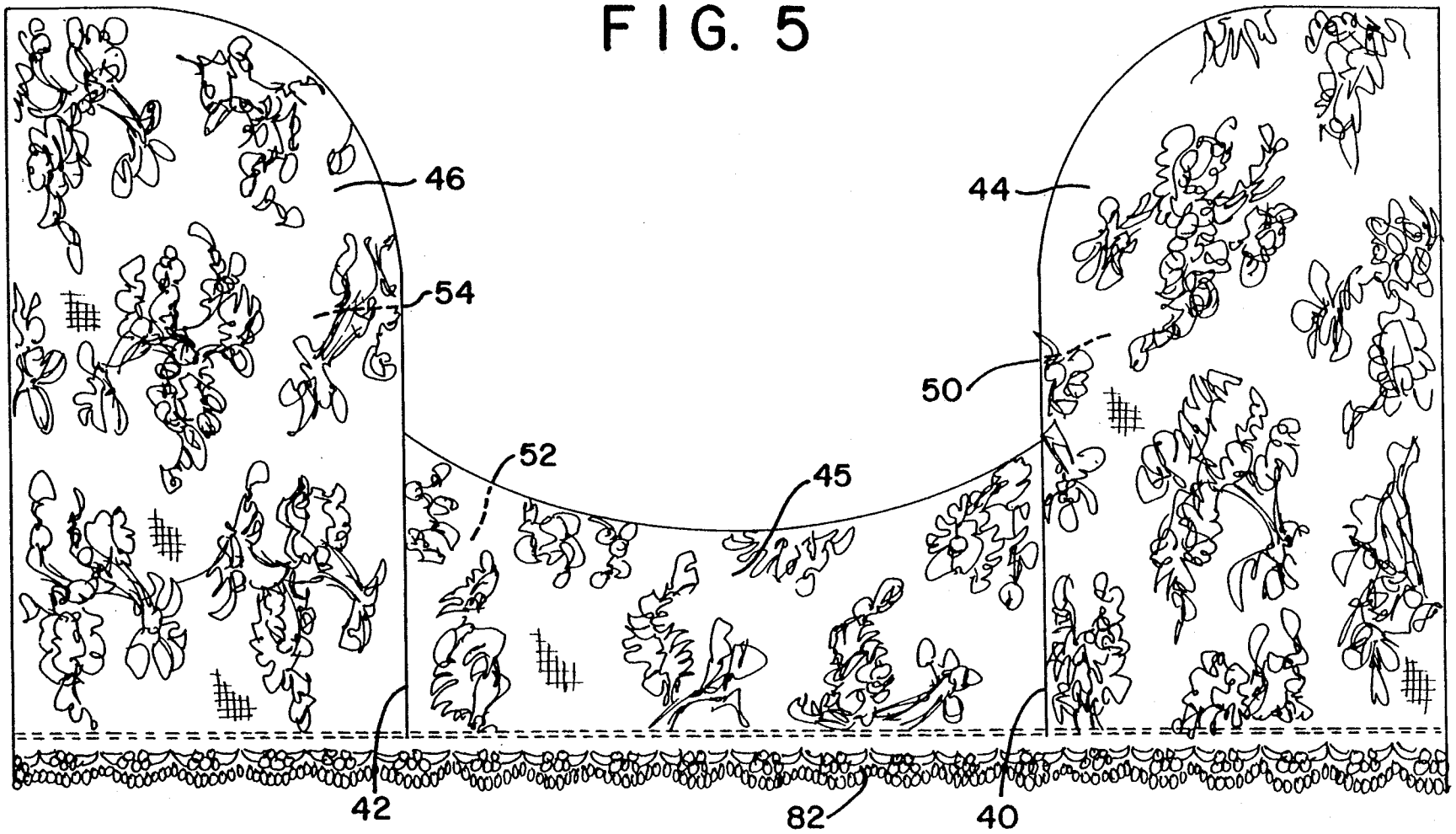
FIG. 5 is a plan view, from above the present invention.

FIG. 5 is a plan view similar to FIG. 4 taken from above showing lace upper panels 44, 45, 46 overlying fabric upper panels 50, 52, 54. These panels are all joined by seams 40, 42.

Figure 6:
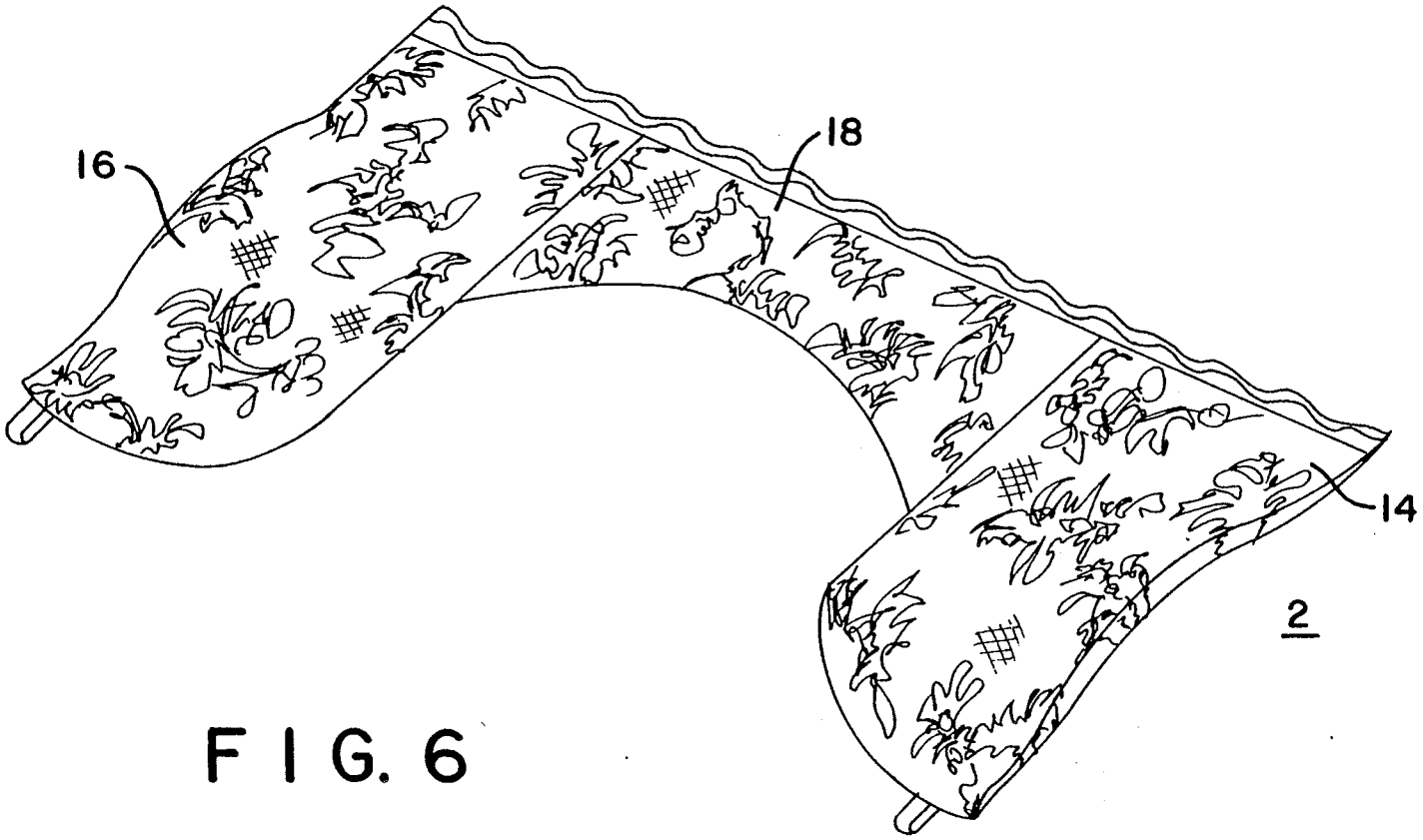
FIG. 6 is an oblique view of the present invention extended and unwrinkled to show the shape of the full device.

FIG. 6 is a slightly oblique view taken from a greater distance in order to show the full unfolded shape of the assembly 2.

Figure 7:
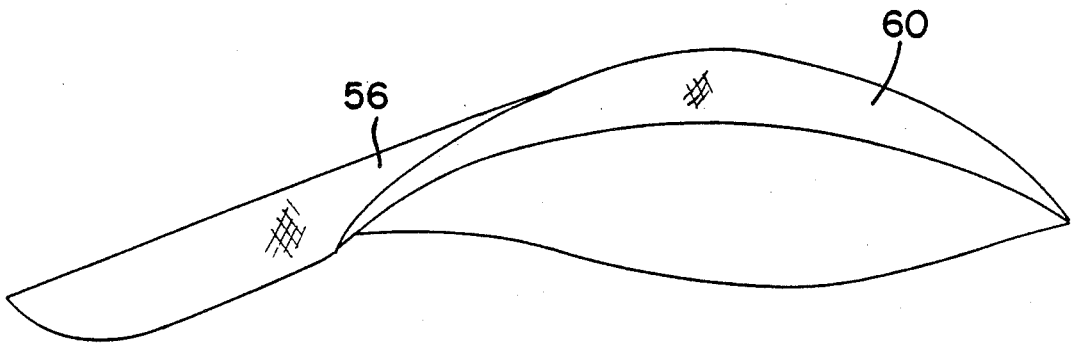
FIG. 7 is a view from the thick edge of a foam shoulder pad such as is used in this assembly.
Figure 8:
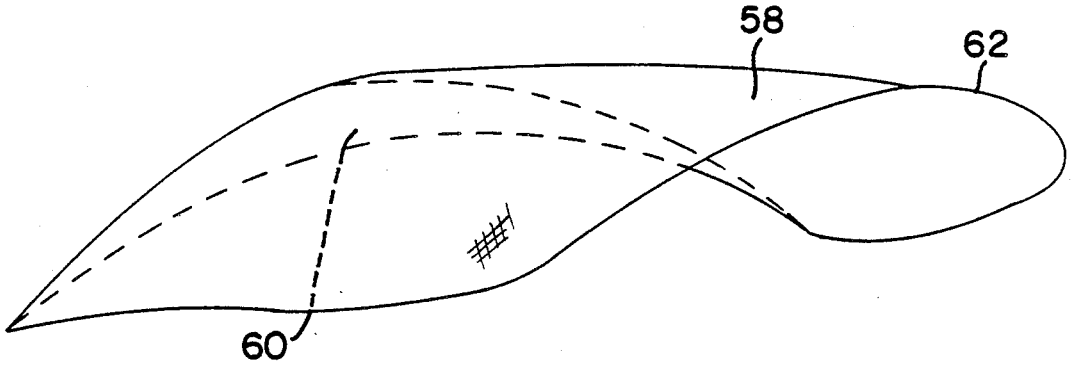
FIG. 8 is an oblique view from the thin edge thereof.

FIGS. 7 and 8 show shoulder pad 56 and 58 showing the thick outer edge 60 of pad 14 and the thin inner edge 62 of pad 16. Hidden outer edge 60 of pad 16 is shown in broken lines.

Assembling the shoulder pad assembly involves the following steps:

Turning now to FIG. 9, the lower back panel 38 is shown obscuring upper back panel 52 as panel 38 overlies the panel 52 inside-out. Seam 70 is stitched into these two panels to join them together. Thread lines 74 illustrate the warp and woof orientation of the fabric.

FIG. 10 is a cross-section of back panel 18 taken through the plane illustrated in FIG. 9 as 10, but after the panel has been turned outside-out. Thus seam 70 is now hidden between taffeta panels 38 and 52.

FIG. 10A shows another embodiment comprising a lace overlay 45 decorating and obscuring upper taffeta panel 52 also joined to the assembly by seam 70.

Figure 11:
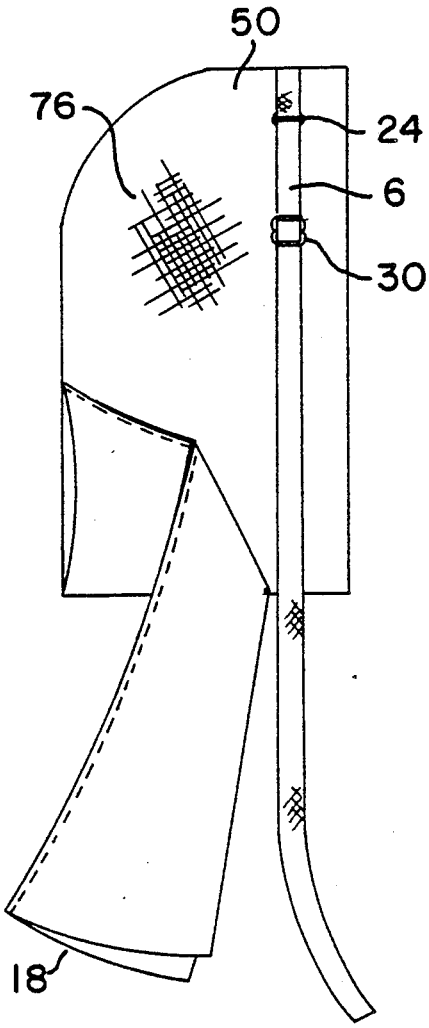
FIG. 11 is a plan view of a shoulder pad pocket upper panel, prior to assembly into the pad pocket, showing the back panel and strap ready to be sewn to the panel.
Figure 12:
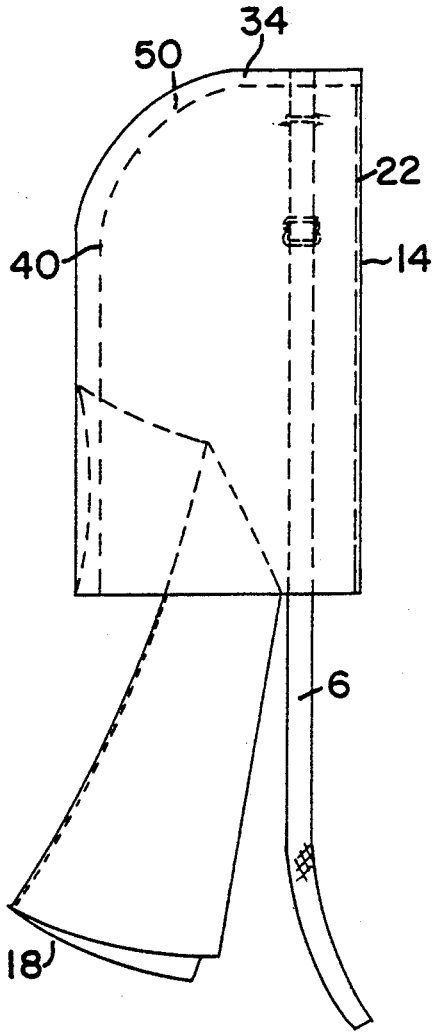
FIG. 12 is a similar view showing a lower panel overlying the materials depicted in FIG. 11 and showing stitching which joins the pad pocket panels, back panel, and strap to comprise a pad pocket. The pad pocket is shown inside-out.

FIG. 11 shows this back panel 18 overlying the outside of a right upper pad pocket panel 50. Note in FIG. 11 that the cloth orientation should be on the bias as is illustrated by thread lines 76. Strap 6 also overlies pad pocket panel 50. To assemble a pad pocket, such as right pad pocket 14 as shown in FIG. 12, right lower panel 34 is placed over right upper panel 50 and stitched along seam 40 which secures panels 34 to 50 and secures back panel 18 along with strap 6 to the pad pocket assembly 14. Seam 22 furthers the enclosure of pad pocket 14 by further joining panels 34 and 50.

Figure 13:
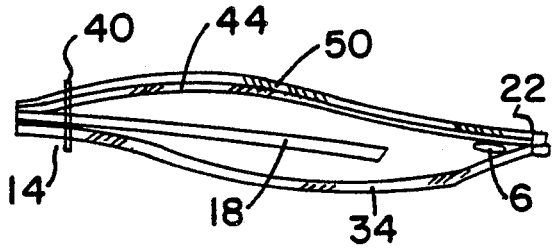
FIG. 13 is an elevation from the temporarily open side of that pocket showing the layers of fabric.

FIG. 13 shows this assembly viewed from the open side and, additionally, includes a layer of lace 50. The pad pocket is turned outside-out by pulling on back panel 18 and strap 6. A second similar back pocket is similarly constructed with the free end of back panel 18 stitched into seam 42, shown in FIG. 14 in a similar manner to that described above.

Shoulder pads 56 and 58 are then inserted into the completed pad pockets 14, 16, making sure that they are precut according to the pocket shape. With the presently available shoulder pads there is a separate pattern for the half-inch shoulder pad and the three-quarter inch shoulder pad. Thick edges of the pads are outward, thin edges are towards the wearer's neck.

Figure 14:
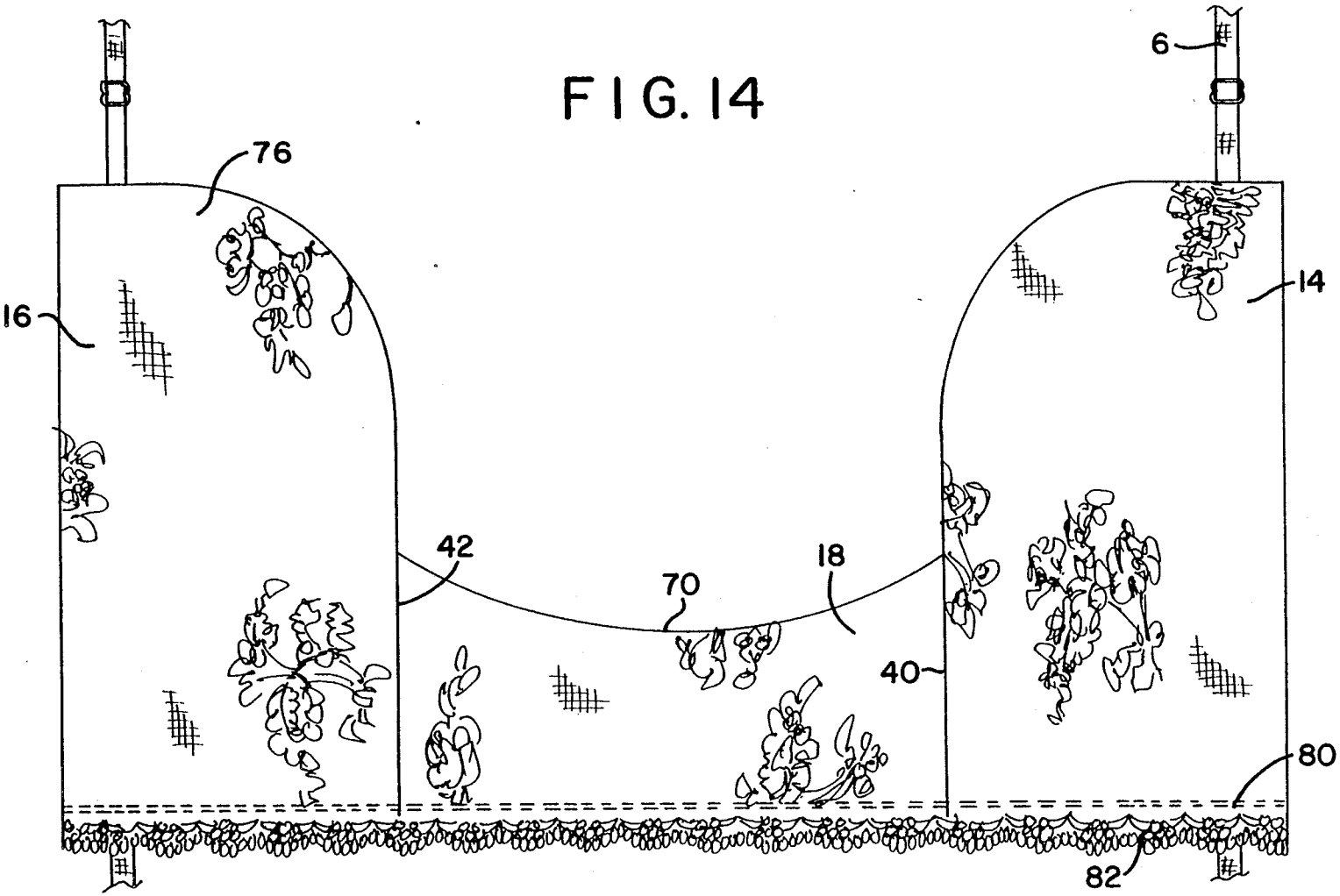
FIG. 14 is a diagramatic sheet which accompanies sewing instructions for assembly of the present invention.

The entire rear of assembly 2 is then marrowed, i.e., sewn with a securing zig-zag stitch at its edge, on seam 80 securing the free ends of strap 6 and 8 to the assembly, and closing pads 56 and 58 in pad pockets 14 and 16, and completing the assembly of back panel 18. Lace trim 82 is then stitched over seam 80 as shown in FIGS. 4, 5 and 14. The shoulder pad assembly 2 is now completed.

Having thus described my invention, I claim:

1. A should pad assembly for fashionably shaping the shoulders of a wearer's clothing, said shoulder pad assembly comprising:

pad means for conforming to a wearer's shoulders, when worn as underwear, and thus adding soft bulk beneath an innermost layer of outergarments of a group consisting of shirts, blouses, dresses, tunics, sweaters, and the like, said pad means for fashionably shaping the shoulders of a wearer's garments, said shoulder pad means comprising a pair of fashionably shaped soft non-rigid comfortable foam shoulder pads comprising a first and second paid;

first pocket means for completely enclosing the first pad;

second pocket means for completely enclosing the second pad;

said pocket means comprising at least an upper pocket panel and a lower pocket panel;

said upper pocket panel and said lower pocket panel stitched together to completely enclose said pads;

back panel means for connecting between said pocket means across the wearer's back behind the wearer's neck, said back panel means comprising an upper panel and a lower panel joined by seams at its front and back edges; said back panel further comprising a pair of ends;

strap means depending from the assembly for extending beneath the wearer's armpits and securing the assembly to the wearer independently of the pressure of any other garment;

all panels comprising soft non-rigid fabric means, of sufficient comfort when worn adjacent skin, and of appropriate asthetics, to comprise means for being worn as underwear;

said strap means comprising elastic material;

means for adjusting the lengths of the strap means, said adjustment means comprising:

a buckle, and an O-ring;

stitching means for joining each of said back panel's ends to respective pad pocket means, and for attaching one end of the ends of each strap means to the assembly, and for joining the upper and lower pocket panels; and a second stitching means for joining all the upper panels to their respective lower panels at said panels' backs, and for completing enclosure of the pads, and for joining another end of each strap means to the assembly.

* * * * *